US005501711A

United States Patent [19]

Weltrowski et al.

[11] Patent Number: 5,501,711

[45] Date of Patent: Mar. 26, 1996

[54] METHOD FOR TREATMENT OF CELLULOSE FABRICS TO IMPROVE THEIR DYEABILITY WITH REACTIVE DYES

[75] Inventors: Marek Weltrowski, Brossard, Canada; Merle S. Masri, Emeryville, Calif.

[73] Assignee: Water & Oil Technologies, Inc., Montgomery, Ill.

[21] Appl. No.: 329,215

[22] Filed: Oct. 26, 1994

[51] Int. Cl.[6] ..... D06P 3/66; D06P 1/46

[52] U.S. Cl. ..... 8/543; 8/549; 8/552; 8/602; 8/108.1; 8/111; 8/541

[58] Field of Search ..... 8/543, 549, 552, 8/602, 108.1, 111, 541

[56] References Cited

U.S. PATENT DOCUMENTS

| | | | |
|---|---|---|---|
| 1,777,970 | 10/1930 | Hartmann . | |
| 3,787,173 | 1/1974 | Greenshields et al. | 8/531 X |
| 4,812,140 | 3/1989 | Russell et al. | 8/492 |

FOREIGN PATENT DOCUMENTS

| | | |
|---|---|---|
| 1445317 | 8/1976 | United Kingdom . |
| 1521240 | 8/1978 | United Kingdom . |
| 1545027 | 5/1979 | United Kingdom . |
| 2119367 | 11/1983 | United Kingdom . |

OTHER PUBLICATIONS

Reinhardt et al, "Properties of dyed cotton fabrics finished with BTCA" 1993 Beltwide Cotton Conf. p. 1472–1476 (ab).

111:196619 CA (abstract) Oishi, Koichi et al, "Effective Utilization of Chitosan for dyeing" 1988, 22–6.

110:9677 CA (abstract) of JP 63175186 Jul. 19, 1988 Tokunaga, Motatgusu.

Burkinshaw et al., "Modification of cotton to improve its dyeability. Part 1—Pretreating cotton with reactive polyamide–epichlorohydrin resin",*J.S.D.C.,* 105:391–398 (1989) no month available.

Einsele, "Uber die Aminierung van Cellulosefasern und deren physikalisches und chemisches Verhalten bei der Textilveredlung", *Melliand Textilberichte,* 45:641–647 (1964).

El Alfy et al., "Improved Cotton Dyeability Via Introducing Dimethyl Amino Ethyl Groups into the Molecular Structure", *American Dyestuff Reporter,* 76(5):22–29 & 48–49 (May 1986).

Evans et al., "Dyeing Behavior of Cotton after Pretreatment with Reactive Quaternary Compounds", *J.S.D.C.,* 100:304 (1984) no month available.

Lewis and Lei, "Improved Cellulose Dyeability by Chemical Modification of the Fiber", *Text. Chem. Color.,* 21(10):23–29 (Oct. 1989).

Lewis and Lei, "New methods for improving the dyeability of cellulose fibers with reactive dyes", *J.S.C.D., 107:102–109 (Mar. 1991).*

Lewis and Lei, "Reactive Fibers: An Alternative to Reactive Dyes", in *American Association of Textile Chemists and Colorists Book of Papers,* pp. 259–265 (International Conference and Exhibition, Atlanta Ga.) (Oct. 4–7, 1992).

Margavio and Guthrie, "Production of a White Aminized Cotton Fabric by Including $NaBH_4$ in the Usual Padding Solution", *American Dyestuff Reporter,* 54(20):71–73 (Sep. 27, 1965).

Masri et al., "Treatment of Cotton to Improve Dyeability and Textile Properties and to Reduce Dye Effluent Discharge", Alex/West (Abstract) (1994) no month available.

Mehta and Combs, "An Improved Process for the Coverage of Neps in the Dyeing of Cotton", in *American Association of Textile Chemists and Colorists Book of Papers,* pp. 214–219 (International Conference and Exhibition, Boston, Mass.) (Oct. 1–3, 1990).

Rippon, "Improving the Dye Coverage of Immature Cotton Fibers by Treatment with Chitosan", *J.S.D.C., 100:298–303 (Oct. 1984).*

Rupin, "Dying with direct and fiber reactive dyes", *Chemical Abstracts,* 85:60 (Abstract 85:178836v) (1976) no month available.

Rupin et al., "Use of reactive quaternary expoxy ammonium compounds in dyeing cellulose with direct and fiber–reactive dyes", *Chemical Abstracts,* 74:56 (Abstract 43423k) (1971).

Soignet et al., "Diethylaminoethyl Cellulose–Epoxide Reactions", *J. Applied Polymer Sci.,* 11:1155–1172 (1961) no month available.

*Primary Examiner*—Margaret Einsmann

*Attorney, Agent, or Firm*—Marshall, O'Toole, Gerstein, Murray & Borun

[57] ABSTRACT

Method of treatment of cellulose fabric to improve the dyeability with reactive dyes by treating with a solution of chitosan oligomers and stabilizng with a solution of sodium cyanoborohydride, sodium borohydride or other similar reducing agents.

11 Claims, No Drawings

METHOD FOR TREATMENT OF CELLULOSE FABRICS TO IMPROVE THEIR DYEABILITY WITH REACTIVE DYES

BACKGROUND OF THE INVENTION

1. Field of Invention

This invention relates generally to a method for improving the dyeability of cellulose fabrics with reactive dyes by the treatment of the fabric prior to dyeing with an aqueous solution of oligomers of chitosan and stabilization by the subsequent treatment with sodium cyanoborohydride, sodium borohydride or other reducing agents. This new method enhances dye uptake, improves the texitle properties, and further reduces dyehouse polluting discharge.

2. Description of Related Technology

Reactive dyes are currently employed for dyeing cellulose fibers and show the greatest growth potential for use because of their wide shade range, ease of application, and excellent wet fastness properties.

There are, however, certain environmental problems related to the utilization of reactive dyes. These problems occur because high electrolyte concentrations must be used during the dyeing process. Additionally, the dyes have relatively poor uptake by the cellulosic fibers because between only 50–90% of the applied dye is covalently bonded to the substrate depending on application method, depth of shade and dye type used. As a consequence, the dyehouse effluents contain an unacceptable level of unfixed reactive dyes, electrolytes, and organohalogen residues which can cause environmental hazards and non-compliance with EPA discharge standards. Thus, a need exists for the treatment of cellulosic fibers to improve the reactive dyes uptake, to reduce the high concentration of electrolyte used in the dye bath, and to reduce the dyehouse toxic discharge without sacrificing the dyeability properties of the cellulosic fibers.

The ideal reactive dyeing process for cellulose fibers would be to exhaust the dye under neutral or slightly acidic conditions in the absence of electrolyte, and fixation of the dyes by raising the dye batch temperature to the boil or to approximately 100° C. However, this process is impossible for the cellulosic fibers because of the existence of significant adverse charge barrier relationships between the negatively charged fibers and the negatively charged dyes in neutral or slightly acidic conditions. This charge barrier can be decreased or eliminated by adding large concentrations of electrolyte and/or by pretreatment of the cellulosic fibers by the introduction of primary amino, secondary amino, or tertiary amino groups to modify the fibers before dyeing with reactive dyes. The same effect can be achieved by the incorporation of fully quaternized cationic amino residues as the pretreatment step.

A number of patents and publications have considered the modification of cellulosic fibers with different classes of amides. Many low molecular weight compounds have been proposed for modification of cellulose. Rupin M., et al. (1970 Textilveredlung 5, 829). In Rupin M., et al. (1976 Textile Chemist and Colorist 8, (9) 139) N-(2-epoxypropyl)-trimethyl ammonium chloride commercialized by Protex, (Levallois, France) as Glytac A, was tested. Bayer, (Leverkusen, Germany) marketed another quaternized cationic amine, Levagen RS, which is glycidyl-N-methyl morpholinium chloride (Gipp, et al., German Offen. 2,407,147). These two quaternized amino products can react with cellulose under alkaline conditions.

Hartmann, U.S. Pat. No. 1,777,970 and from Margavio etal., (1965 American Dyestuff Reporter 54, (20) 71) discloses that 2-aminoethylsulfate can be introduced to the cellulosic fibers by thermal treatment in the presence of sodium hydroxide. Einsele-(1964, Milliand Textilberichte 45, 841) teaches that the resulting modified cellulose can be treated with monochloro-s-triazine reactive dyes. Good dye uptake and fixation was obtained in slightly acidic or neutral condition in the absence of electrolytes.

β-chloroethyl-diethylamino hydrochloride has also been incorporated into cellulose under basic conditions. Soignet, D. M., et al. (1967 Journal of Applied Polymer Science 11, 1155). The resulting modified cellulose was tested by El Ally E. A., et al. (1986 American Dyestuff Reporter 76,(5) 22). Excellent affinity for reactive dyes was observed even for 2,4-difluoromonochlopyrimidine dyes. Lewis D. M., and Lei X. P. (1991 Journel of the Society of Dyes and Colourists (J.S.D.C.), 107, 191). Moreover, cellulose was treated with N-methylacrylamide and followed by ammonia, methylamine, dimethylamine, triethylamine and/or ethanolamine treatment. The resulting cellulose fibers could then be dyed with reactive dyes in the absence of electrolyte under neutral to slightly acidic conditions.

Other reactive quaterary compounds have been reported for treatment of cellulose to improve the reactive dyes affinity. Evans, G. E., et al. (1984 J.S.D.C, 100, 304); Kalk, W., et al, German Offen. 2,626,495; Perrin, P., et al., German Offen. 2,726,433; Stead, C. V., et al., U.K. Pat No. 2,119,367.

Polymeric compounds also have been used for cellulose treatment to improve the dyeability of fabrics. Courtaulds Co. and Sandoz Chemical Corp. (Basle, Switzerland) developed a cationic polymer pretreatment process (1989 Courtaulds Research Brochure Sandene Process). The resin, Sandene 8425, increased substantivity of cellulose for reactive anionic dyes and can be applied under neutral to weekly acidic conditions.

A reactive polyamide-epichlorohydrin resin (Hercosette 125 available from Hercules, Inc.) was studied for cellulose treatment of fabric by Burkinshaw S. M.,et al. (1989 J.S.D.C., 105, 391) with good results. Treated cellulose fibers could be dyed with highly reactive dyes without salt, or electrolytes from dye baths set at pH 7. Lewis D. M., et al. (1989 Text. Chem. Colorist 21, (10) 23) proposed the modification of this treatment which consists of an application of Hercosette or DMA-AC (1,1-dimethyl-3-hydroxyazetidinium chloride) in the presence of low molecular amine or thiol compounds.

Pretreatment, by the application of chitosan applied by the exhaust process to cover the immature (thin-walled) cotton fibers prior to dyeing with direct dyes has also been proposed. (Rippon J. A., 1984 J.S.D.C., 100, 298). Chitosan is a partially deacetylated poly (N-acetyl-D-glucosamine). This natural polymer is obtained from chitin by partial deacetylation in basic conditions. The application of chitosan by exhaust processing was investigated to improve the coverage of immature cotton fibers which were dyed with direct and reactive dyes. Mehta R. D. and Combs R. N. (Book, Pap.—Int. Conf. Exhib., AATCC, October 1–3, 1990, Boston, Mass., p. 214) Good results were obtained when the dyeing process was used with direct and reactant fixable Indosol dyes. This pretreatment was not as effective when using reactive dyes. However, in the case of reactive dyes, the chitosan treatment improved colour yields but caused increased stiffness of the fabric.

Thus, improvements have been sought to develop dye systems of increased substantivity under neutral or slightly acidic conditions which can decrease or possibly eliminate the amount of electrolytes required to be used during the dyeing process and to increase the efficiency of the dye to fiber covalent bonding reaction without sacrificing desirable textile properties.

SUMMARY OF INVENTION

It is an object of this invention to overcome one or more of the problems described above.

According to the invention, a method for treating cellulose fabrics to improve their dyeability with reactive dyes by use of oligomers of chitosan which are treated after a preliminary mild oxidative or bleaching step and subsequently stabilized or fixed by reducing agents which can be sodium borohydride, sodium cyanoborohydride or other suitable reducing agents. This new method not only increases dyeability of the cellulosic fibers but also improves other desirable textile properties such as improved fabric softness, shrinkage control and wrinkle recovery. This invention also reduces the dyehouse toxic discharge level. The method of the invention applies to such fabrics manufactured from cotton, flax, hemp, jute, ramie, viscose, rayon, or from mixtures conaining one or more of the above cellulose fibers.

Specifically, bleached cellulose fabric is pretreated by mild oxidation with hydrogen peroxide or hypochlorous acid or similar oxidants. The pretreated fabric is then padded with a solution of oligomers of chitosan. The oligomers of chitosan are then stabilized or fixed by reductive treatment with sodium borohydride, or cyanoborohydride. The resultant fabric is then dyed with monochlorotriazine, dichlorotriazine, vinyl sulfone, or other reactive dyes. This method also allows a decrease in the concentration of electrolytes or salts in the dye baths. Additionally, this method is equally applicable for applying the oligomers of chitosan directly to the bleached fabric without the oxidation pretreatment step.

Other objects and advantages of the invention will be apparent to those skilled in the art from a review of the following detailed description of the appended claims.

DETAILED DESCRIPTION OF THE INVENTION

According to the invention, it has been found that cellulose fabric, can be slightly oxidized by bleaching treatment or other mild oxidizing treatments, and next treated in the presence of a reducing agent with oligomers of chitosan obtained by hydrolysis (enzymatic or chemical) of this natural polymer. The resultant treated fabric is then stabilized by sodium borohydride, cyanoborohydride, or other suitable reducing agents and then dyed. This new method provides high uptake of reactive dyes to the fabric. Moreover, this method decreases the use of electrolytes in dye baths.

The utilization of oligomers of chitosan in this treatment method is believed to be new and permits the permanent chitosan fixation on the cellulosic fabric by a new method of fixation of the chitosan oligomers on the cellulosic fibers. Moreover, the method of this invention will economize the amount of dye used and also contribute to reduce the dyehouse polluting discharge.

More specifically, the invention is directed to a method for chemical modification of cellulosic fibers which method is comprised essentially of the following steps. Bleached cellulosic fabric can be obtained by scouring and bleaching the fabric with hydrogen peroxide, hypochlorite, or chlorite or other similar oxidants according to the conditions and methods studied from the literature. However, unbleachled cellulose fabric may be substituted for the bleached fabric and used according to this invention.

The first step of the invention consists of the mild oxidation of the bleached cellulose fabric with hydrogen peroxide or hypochlorous acid under acidic conditions. However, if the fabric is sufficiently bleached, this step may be optional. This pretreatment is carried out in acidic conditions, in the range of about pH 3 to pH 5, preferably at pH 4.5. The temperature of pretreatment is 25° C. to 100° C., preferably 100° C. The time of pretreatment is 1 hour to 24 hours, but preferably 1 hour. The concentration of hydrogen peroxide is 0.5 to 5%, preferably 3% wt/wt. (by weight of $H_2O_2$) This oxidation step imparts a reducing oxycellulose character to the cellulose fiber in which, new, predominantly aldehyde groups are generated.

In the second step, a solution of oligomers of chitosan obtained by the hydrolysis of chitosan are applied to the treated cellulosic fabric by padding, coating or exhaustion methods, preferably by padding. In the padding method the concentration of chitosan oligomers and the pick-up of the padding machine are fixed to obtain about 5 to 50 milligrams per gram of fabric meter of dry chitosan oligomer content onto the cellulosic treated fabric. The preferred fixation rate is 30 milligrams per square meter. After padding, the fabric is treated at room temperature for approximately 10 to 300 minutes, preferably at 60 minutes, and then dried at a temperature under 100° C., preferably 60° C. However, the fabric after treatment at room temperature can be directly treated with reducing agents.

It is believed that the aldehyde groups from the previous oxidation step react with the chitosan oligomers to create a crosslinking effect through Schiff base formation. Because only part of the amino groups on a single chitosan oligomer chain participate in the Schiff base reaction, non-participating amino groups remain free but covalently attached to the cellulose throughout the chain. Thus, in addition to the crosslinking, the cellulose acquires amino residues which are most likely responsible for the increased dye uptake.

The chitosan oligomer treated fabric is next stabilized or fixed onto the cellulose fibers by stabilizing the covalent bonding with reducing agents, particularly, a solution of sodium cyanoborohydride or sodium borohydride depending on the nature of the dye. However, other suitable reducing agents may be used. The following conditions are applied for sodium cyanoborohydride treatment. The liquid ratio of fabric to liquor is 1:10 to 1:100, but preferably 1:40, while the concentration of sodium cyanoborohydride is about 0.5 g/l to about 10 g/l, and 3.5 g/l is preferred. The pH of the treatment solution is between about pH 3 to pH 8, with pH 4 being preferred. The reaction time is typically about 1 to 6 hours at room temperature (give range), with 2 hours being usually sufficient reaction time.

Similar conditions of treatment are used for sodium borohydride, with one exception. The pH of the treatment solution is between 6 and 10, preferably a pH of 8.5.

Stabilization can also be achieved through a second crosslinking reaction involving some of the amino groups generated in the cellulose in the second step by use of a dialdehyde or reactive cyclic ethylene N-dimethylol urea as crosslinkers with or without the addition of extra oligomers of chitosan. This stabilization step may require additional stabilization with a suitable reducing agent as disclosed above. The application of oligomers of chitosan and stabilization with reactive cyclic ethylene N-dimethyl urea may be accomplished in one step as exemplified in Example 7. The fabric is treated with oligomers of chitosan and reactive cyclic ethylene N-dimethylol urea in the presence or absence or a metallic catalyst, such as magnesium chloride. The treated fabric is then dried at about 60°–80° C. and cured at about 160° C. for approximately 3 minutes.

The mechanisim is believed to be that the Schiff base crosslinks are stabilized by the reduction with sodium borohydride or cyanoborohydride. The crosslinking achieved in the second step of this method and stabilized in the third step contributes to the stabilization of the cellulose fiber structure and which is related to wrinkle resistance and shrinkage control.

In one embodiment of this invention, the application of chitosan oligomers by padding can be applied directly to the bleached cellulose fabric without an oxidative pretreatment step utilizing hydrogen peroxide or hypochlorous acid. This method is exemplified in Examples 1 and 7.

After treatment, the cellulosic fabric is then rinsed thoroughly with water and directly dyed or dried at the temperature under 105° C. The resultant treated fabric is next dyed with reactive dyes such as monochlorotriazine, dichlorotriazine, vinyl sulfone or other reactive or textile dyes. However, an important aspect of the invention is that the treated fabric can also be dyed without the presence of electrolytes (salts) in the dye bath. In the both cases, with or without the addition of electrolytes, increased dye exhaustion and significant increases in color yield are observed as set out in the examples. Other dyes were used according to this procedure with succesful results, including Remazol Yellow GR, Intrachron Orange, and Neolan Blue.

The oligomers of chitosan used in accordance with this invention can be obtained by acid or enzymatic hydrolysis of solubilized chitosan (unbranched linear chains of β-D (1→4) linked 2-deoxy-2-amino-D-glucose units). Commercial chitosan is obtained by deacetylation of shrimp and crab shell chitin and is available from Water and Oil Technologies, Inc., Montgomery, Ill. The concentration of acid is 0.01N to 10N, preferably 0.3N. The temperature of acid treatment is situated between 25° C. and 100° C., preferably at 100° C. The time of acid treatment is 30 minutes to 10 hours, with rapid loss of viscosity, but preferably 1 hour. The resulting solution of chitosan oligomers is evaporated under vacuum ( p.s.i. 0.32–0.70) and the resultant chitosan oligomer powder is dried.

The method of this invention constitutes two new aspects in comparison with the prior methods in the art. The first aspect the invention provides the application of a new amino reactive agent which is the oligomers of chitosan obtained by the hydrolysis of chitosan. The use of chitosan caused the increasing of stiffness of cellulosic fabric and the harsh hand of the fabric. However, the utilization of the product of the present invention which uses oligomers of chitosan (hydrolysis of chitosan) completely eliminated this secondary effect.

The second aspect the invention provides a new method of fixation of chitosan oligomers on cellulosic fabric by the use of sodium borohydride, sodium cyanoborohydride or other reducing agents. Previously chitosan was fixed on the fabric by formaldehyde glyoxal based reactant and thermic treatment (Mehta R. D., Combs R. N., Book Pap.—Int. Conf. Exhib., AATCC, Oct. 1–3, 1990, Boston, Mass., p. 214), or by simple thermic treatment (Rippon J. A., 1984, J.S.D.C., 100, 298).

The exhaust % in the examples indicates what part of the total dye quantity is present in the dye bath which was eliminated from the bath during the dyeing process. This eliminated dye could be fixed on the fabric in a permanent or unpermanent manner. This is somtimes referred to in the art as wash fastness. The dyes fixed in an unpermanent manner are eliminated from the fabric during washing and soaping after dyeing. To evaluate the permanent fixation of the dye onto the fabric, the colour yield is measured. Colour yield is expressed by a K/S factor. This factor is obtained by spectroscopy in reflected light and is proportional to the depth of the shade (K/S). Even a small change in K/S value corresponds with very visible shade changes. The increasing K/S value exemplified in the examples is very significant.

Comparing the results for dyeing the pretreated fabric with different reactive dyes to the results from the conventional dyeing of untreated fabric, it can be seen that colour strength of the dyeing obtained on the former is significantly greater than the dyeings on the untreated fabric. This indicates a large savings in dye consumption may be made.

Moreover, this method also provides that fabric stiffness of the fabrics treated with oligomers of chitosan are the same or better than those fabrics which were left untreated, The stiffness of low viscosity chitosan treated fabrics are higher than those of the untreated and chitosan oligomer treated fabrics, as can be seen in Example 6. The recovery angle is proportional to the stiffness. The direct measurement of stiffness is by the Kawabata system which is well known in the art. This method is described in the book *The Standardization and Analysis of Hand Evaluation, Second Edition,* by S. Kawabata, The Textile Machinery Society of Japan, July 1980. It is also described in U.S. Pat. No. 4,812,140. The results show that the chitosan oligomer treated fabric is even slightly better than the non-chitosan treated fabric.

Thus, the process of this invention has the distinct advantage over the prior methods in that the cellulosic fabrics treated according to the invention and next dyed with monochlorotriazine, dichlorotriazine, vinyl sulfone or other reactive dyes, provide higher exhaustive and colour yield than those of the untreated fabrics. Moreover, this method decreases the use of electrolytes in the dye baths and improves fabric hand and softness as shown in the following examples.

EXAMPLES

The following specific examples are provided in order to illustrate the practice of the invention, but are not to be construed to limit the scope of the invention.

EXAMPLE 1

Forty (40) grams of chitosan (obtained from Water & Oil Technologies, Montgomery, Ill.) were dissolved in 3000 ml of 0.3 N hydrochloric acid and boiled for 1 hour. The resulting mixture was cooled and the hydrochloric acid was evaporated under vacuum (p.s.i. 0.32–0.70) (Rotvapor Buchi, Switzerland). The resulting powder of chitosan oligomers was used for preparation of a padding solution for the cotton fabric treatment.

Two samples A and B of bleached and unmercerized cotton fabric (cotton print cloth 400, Testfabrics Inc., 109 g/m$^2$) were padded with the solution of chitosan oligomers according to the methods of the invention. A third sample C was not treated and was used as the control. Sample A was treated in sodium cyanoborohydride solution: concentration 3.5 g/L, pH 4 for 2 hours at room temperature. The fabric to liquid ratio was 1:40. Sample B was treated in sodium borohydride solution, concentration 3.5 g/L, pH 8.5 for 2 hours at room temperature. The fabric to liquid ratio was 1:40. Both samples were treated for 60 minutes at room temperature followed by 10 minutes at 60° C. (Finishing line, Benz). Both fabrics were rinsed thoroughly with water after treatment. The dry chitosan oligomers content in both samples was 26 mg of oligomers per gram of fabric.

Samples A and B and Control Sample C were dyed in an Ahiba Polymat laboratory dyeing machine with a vinyl sulphone dye, CI Reactive Blue 19 (Remazol Brillant Blue R, Hoeschst) according to the method recommended by the manufacturer. The fabric to liquid ratio was 1:40 and the dye concentration was 1% o.w.f. (on weight of fabric).

The fabrics were kept in a solution of dye and 50 g/l electrolyte ($Na_2SO_4$) for 10 minutes at 25° C. The temperature was then raised to 60° C. for a period of 25 minutes. 10 g/l alkali was added ($Na_3PO_4$) and the dye bath was kept at 60° C. for over 60 minutes. The dyed fabrics were rinsed thoroughly in tap water, soaped 15 minutes (Levapon 1 g/L, 100° C., Ahiba Polymat) and rinsed at 70° C. and rinsed again at 25° C. The dye bath exhausts were analyzed by the spectrophotometric technique (Spectrophotometer Lambda 4B, Perkin Elmer). The colour yield of dyed samples were evaluated by measurement of Kubelka-Munk K/S values (ACS CS-5 Colour Measurement System, Applied Colour System, Inc.). The following evaluation data was obtained:

| SAMPLE | EXHAUST % | COLOUR YIELD K/S |
|---|---|---|
| Sample A Treated ($NaBH_3CN$) | 76 | 6.983 |
| Sample B Treated ($NaBH_4$) | 83 | 9.203 |
| Control C Untreated | 77 | 4.026 |

EXAMPLE 2

Two samples A and B of the same bleached and unmercerised cotton fabric as described in Example 1 were treated in a 3% solution of hydrogen peroxide at 100° C. for 1 hour at pH 3.5. The two treated cotton fabrics samples A and B were then treated with chitosan oligomers according to the method presented in Example 1. The resulting two samples were separately treated: Sample A was treated with a solution of sodium cyanoborohydride and Sample B was treated with a solution of sodium borohydride, both prepared according to the method described in Example 1. Samples A, B and one untreated control sample C were dyed with a vinyl sulfone dye CI Reactive Black 5 (Levafix Black E-B, Bayer) according to the method recommended by the manufacturer. The fabric to liquid ratio and dye concentration was respectively 1:40 and 1% o.w.f. The samples were kept in the solution of dye and electrolyte (NaCl, 50 g/L) at 25° C. for 10 minutes. The temperature was raised to 60° C. for 25 minutes. An alkali was added ($Na_2CO_3$, 15 g/L) and the dye bath was kept at 60° C. over 60 minutes. The samples were rinsed and soaped according to the method set out in Example 1. The results of the dyeing evaluations obtained by the same methods as described in Example 1 were as follows:

| SAMPLE | EXHAUST % | COLOUR YIELD K/S |
|---|---|---|
| Control Sample C* | 69 | 9.981 |
| Sample A ($NaBH_3CN$) | 63 | 15.312 |
| Sample B ($NaBH_4$) | 63 | 14.361 |

*Treated only with hydrogen peroxide solution.

EXAMPLE 3

Two samples A and B of cotton fabric were obtained according to the method described in Example 1. Samples A and B and one untreated control sample C were dyed with a dichlorotriazine dye, CI Reactive Red 2 (Basilen Red M-SB, BASF) according to the method recommended by the manufacturer. The liquid ratio and dye concentration were respectively 1:40 and 1% o.w.f. All samples were kept in the solution of dye and electrolyte (NaCl at 40 g/L) for 40° C. for 10 minutes. The temperature was raised to 60° C over 25 minutes. An alkali was added ($Na_2CO_3$, at 15 g/L) and the dye bath was kept at 60° C. for 45 minutes. The samples were rinsed and soaped according to the method presented in Example 1. The results of the dyeing evaluations were obtained by the same methods as described in Example 1. The results are as follows:

| SAMPLE | EXHAUST % | COLOR YIELD K/S |
|---|---|---|
| Control Sample C | 59 | 1.855 |
| Sample A ($NaBH_3CN$) | 81 | 9.895 |
| Sample B ($NaBH_4$) | 83 | 8.881 |

EXAMPLE 4

Two identical samples A and B were obtained according to the method presented in Example 1 (reductor agent $NaBH_3CN$). Sample A and one untreated control sample A-1 were dyed with a monochlorotriozinvl dichlorotriozine dye CI Reactive Blue 4 (Basilen Blue M-R, BASF) according to the method recommended by the manufacturer. The second sample B treated with oligomers of chitosan and one untreated control sample B-1 were dyed by the same method but in the absence of an electrolyte (NaCl, 40 g/L). The dyeing method for all samples was as follows: the liquid ratio and dye concentration were respectively 1:40 and 1% o.w.f. The samples were kept in the solution of dye at 25° C. for 5 minutes. The temperature was raised to 40° C. for 5 minutes and an alkali was added only in case of the samples A and A-1 samples (NaCl, 40 g/L). The dye bath was kept at 40° C. over 10 minutes and then the temperature was raised to 60° C. for 20 minutes. The alkali was added ($Na_2CO_3$, 15 g/L) and the dye bath was kept at 60° C. for 45 minutes. All samples were rinsed and soaped according to the method presented in Example 1. The results were obtained by the same method as described in Example 1. The results are set out below:

| SAMPLE | EXHAUST % | COLOR YIELD K/S |
|---|---|---|
| Control A-1 | 48 | 1.576 |
| Control B-1 without salt | 30 | 1.003 |
| Treated Sample A | 61 | 6.098 |
| Treated Sample B without salt | 46 | 3.744 |

EXAMPLE 5

Two samples A and B of cotton fabric were obtained according to the method described in Example 1. Samples A and B and one untreated control Sample C were dyed with a monochlorotriazine dye, CI Reactive Red 24 (Basilen Red Brillant P-B, BASF), according to the method recommended by the manufacturer. The liquid ratio and dye concentration were respectively 1:40 an 1% o.w.f. All samples were kept in the solution of dye and electrolyte (NaCl, 40 g/L) at 40° C. for 10 minutes. The temperature was raised to 80° C. for 60 minutes. The samples were rinsed and soaped according to the method presented in Example 1. The results were obtained by the same method as described in Example 1. They are as follows:

| SAMPLE | EXHAUST % | COLOUR YIELD K/S |
|---|---|---|
| Control C | 30 | 1.570 |
| Sample A ($NaBH_3CN$) | 29 | 1.763 |

-continued

| SAMPLE | EXHAUST % | COLOUR YIELD K/S |
|---|---|---|
| Sample B ($NaBH_4$) | 31 | 1.809 |

EXAMPLE 6

One sample A of chitosan oligomer treated fabric was obtained according to the method presented in Example 1 (reducing agent $NaBH_3CN$). A second sample B of treated fabric was obtained by the method presentd in Example 1 with two exceptions. Firstly, instead of a solution of chitosan oligomers, the solution of low viscosity chitosan was used. Secondly, instead of application of the polymer solution on the fabric by padding, the application by coating was realized (Finishing Line, Benz). In the case of the two fabricated samples, the same content of polymer (chitosan oligomers or chitosan) was used (about 35 mg per gram of fabric). The two samples A and B were dyed with a dichlorotriazine dye, CI Reactive Blue 4 (Basilen Blue M-R, BASF), according to the method presented in Example 4. Wrinkle recovery of both treated and dyed fabrics was tested by measurement of recovery angle according to AATCC Test Method 66-1990 "Wrinkle Recovery of Fabrics: Recovery Angle Method." The untreated, undyed bleached fabric sample C was also evaluated by this test. The results are as follows:

| | AVERAGE RECOVERY ANGLES (°) | |
|---|---|---|
| SAMPLE | WARP | FILLING |
| Control Sample C | 102 | 95 |
| Treated with low viscosity chitosan-Sample B | 35 | 46 |
| Treated with chitosan's oligomers-Sample A | 95 | 89 |

One bleached and untreated fabric sample was dyed with CI Reactive Blue 4 (Basilen Blue M-R, BASF) according to the method presented in Example 4. Both, bleached, untreated and dyed sample and bleached, treated with oligomers of chitosan and dyed sample were evaluated by Kawabata Evaluation System by measurement of stiffness. The results are as follows:

| | STIFFNESS (g. $cm^2/cm$ | |
|---|---|---|
| SAMPLE | WARP | FILLING |
| Control (only dyed) | 0.191 | 0.068 |
| Treated with chitosan's oligomers and dyed | 0.170 | 0.065 |

EXAMPLE 7

One sample of bleached and unmercerized cotton fabric was padded with the aqueous solution of 4% DMDHEU (dimethylol dihydroxyethylene urea), 1.2% $MgCl_2 \cdot 6H_2O$ (magnesium chloride) and 6% of chitosan's oligomers. The second sample of bleached and unmercized cotton fabric was padded with the aqueous solution of 4% DMDHEU and 1.2% of $MgCl_2 \cdot 6H_2O$. In both samples the wet pickup was 100%. Next both treated fabrics were dried at 80° C. and cured at 160° C. for 3 minutes. The control sample (bleached and unmercerized cotton fabric) and two treated fabrics were dyed with Cl Reactive Red 2 (Basileln Red M-5B, BASF) according to the method presented in Example 3. The results of the dyeing evalulations were obtained by the same method as described in Example 1. They are as follows:

| SAMPLE | EXHAUST % | COLOR YIELD K/S |
|---|---|---|
| Control | 59 | 1.855 |
| Treated with DMDHEU | 48 | 1.205 |
| Treated with DMDHEU and chitosans oligomers | 63 | 2.289 |

The foregoing description is given for clearness of understanding only, and no unnecessary limitations should be understood therefrom, as modifications within the scope of the invention will be apparent to those skilled in the art.

We claim:

1. A method of improving the dyeability of cellulose fabric by reactive dyes, said method comprising the following steps:

(a) pretreating the cellulose fabric with an oxidizing agent;

(b) applying chitosan oligomers to the cellulose fabric;

(c) stabilizing the product of step (b) by treating with a solution of a reducing agent; and (d) dyeing the resultant product of the steps with a reactive dye.

2. The method of claim 1 wherein the oxidizing agent in step (a) is hydrogen peroxide or hypochorous acid.

3. The method of claim 1 wherein the reducing agent of step (c) is cyanoborohydride or sodium borohydride.

4. The method of claim 1 wherein the reactive dye of step (d) is a monochlorotriazine, dichlorotriazine or vinyl sulfone dye.

5. The method of claim 1 wherein step (a) is optional.

6. A method of improving the dyeability of cellulose fabric by reactive dyes, said method comprising the following steps:

(a) pretreating the cellulose fabric with an oxidizing agent;

(b) applying chitosan oligomers to the cellulose fabric;

(c) stabilizing the product of step (b) by treating with a solution of dialdehyde or reactive cyclic ethylene N-dimethylol urea;

(d) further stabilizing the product of step (c) with a reducing agent;

(e) dyeing the resultant product of the steps with a reactive dye.

7. The method of claim 6 wherein step (a) and step (d) are optional.

8. The method of claim 6 wherein the oxidizing agent in step (a) is hydrogen peroxide or hypochorous acid.

9. The method of claim 6 wherein the reducing agent of step (d) is cyanoborohydride or sodium borohydride.

10. The method of claim 6 wherein the reactive dye of step (e) is a monochlorotriazine, dichlorotriazine or vinyl sulfone dye.

11. A method of improving the dyeability of cellulose fabric by reactive dyes, said method comprising the following steps:

a) Applying chitosan oligomers together with a reactive cyclic ethylene N-dimethylol urea in the presence or without presence of a metallic catalyst to the cellulose fabric;

b) Stabilizing the product of step (a) by curing; and c) Dyeing the product of step (b) with a reactive dye.

* * * * *

UNITED STATES PATENT AND TRADEMARK OFFICE

CERTIFICATE OF CORRECTION

PATENT NO. : 5,501,711

DATED : March 26, 1996

INVENTOR(S) : MAREK WELTROWSKI ET AL.

It is certified that error appears in the above-identified patent and that said Letters Patent is hereby corrected as shown below:

Column 2, line 17, "Journel" should be --Journal--.

Colunn 4, lines 12, 13, "$H_2O_2$" should be --$H_2O_2$--.

Column 5, line 22, "succesful" should be --successful--.

Column 7, line 62, "M-SB" should be -- M-5B --.

Colunn 8, line 54, "an" should be --and--.

Column 9, line 12, "presentd" should be --presented--.

Signed and Sealed this

First Day of October, 1996

Bruce Lehman

*Attest:*

BRUCE LEHMAN

*Attesting Officer*

*Commissioner of Patents and Trademarks*